United States Patent [19]

Flegal et al.

[11] Patent Number: 4,982,183

[45] Date of Patent: Jan. 1, 1991

[54] ALTERNATE POLARITY SYMMETRIC DRIVE FOR SCANNING ELECTRODES IN A SPLIT-SCREEN AC TFEL DISPLAY DEVICE

[75] Inventors: Robert T. Flegal, Beaverton; Michael J. Ziuchkovski, Portland, both of Oreg.

[73] Assignee: Planar Systems, Inc., Beaverton, Oreg.

[21] Appl. No.: 221,747

[22] Filed: Jul. 19, 1988

Related U.S. Application Data

[63] Continuation-in-part of Ser. No. 166,417, Mar. 10, 1988, abandoned.

[51] Int. Cl.[5] ..... G09G 3/30

[52] U.S. Cl. ..... 340/781; 340/805; 340/825.81; 315/169.3

[58] Field of Search ..... 340/781, 825.81, 805, 340/719, 760, 811; 315/169.3, 169.4, 169.2

[56] References Cited

U.S. PATENT DOCUMENTS

| | | | |
|---|---|---|---|
| 4,338,598 | 7/1982 | Ohba et al. | 340/825.81 |
| 4,468,659 | 8/1984 | Ohba et al. | 340/719 |
| 4,485,379 | 11/1984 | Kinoshita | 340/825.81 |
| 4,586,039 | 4/1986 | Monomura et al. | 340/784 |
| 4,686,426 | 8/1987 | Fujioka et al. | 340/825.81 |
| 4,716,341 | 12/1987 | Oida et al. | 315/169.4 |
| 4,733,228 | 3/1988 | Flegal | 340/781 |
| 4,739,320 | 4/1988 | Dolinar et al. | 340/781 |
| 4,816,816 | 3/1989 | Usui | 340/784 |
| 4,823,121 | 4/1989 | Sakamoto et al. | 340/825.81 |
| 4,830,466 | 5/1989 | Matsuhashi et al. | 340/784 |

FOREIGN PATENT DOCUMENTS

| | | | |
|---|---|---|---|
| 2161011 | 1/1986 | United Kingdom | 340/719 |
| 2161011A | 1/1986 | United Kingdom . | |
| 2165078A | 4/1986 | United Kingdom . | |

*Primary Examiner*—Jeffery A. Brier

*Attorney, Agent, or Firm*—Chernoff, Vilhauer, McClung & Stenzel

[57] ABSTRACT

A matrix-addressed AC TFEL panel includes odd- and even-numbered scanning electrodes driven from opposite sides of the panel by separate power supplies. The data electrodes are divided into top and bottom sets so that they are arranged as complementary pairs extending towards each other slightly less than halfway across the screen leaving a small gap in the middle. The odd- and even-numbered scanning electrodes are divided into top and bottom subsets so that the top and bottom halves of the panel may be scanned simultaneously in line-by-line fashion. When an even electrode in the top half of the panel is scanned with a voltage of a first polarity, an odd electrode in the bottom half may be scanned with a voltage of an opposite polarity. Thus, the load for the scanning of the top and bottom halves is divided between positive and negative power supplies. To provide symmetric drive the polarities may be reversed each frame.

5 Claims, 2 Drawing Sheets

ALTERNATE POLARITY SYMMETRIC DRIVE FOR SCANNING ELECTRODES IN A SPLIT-SCREEN AC TFEL DISPLAY DEVICE

This application is a continuation-in-part of application Ser. No. 166,417 entitled "Symmetric Drive Network For A TFEL Panel" filed Mar. 10, 1988, now abandoned, and is assigned to the same assignee.

BACKGROUND OF THE INVENTION

The following invention relates to a method and apparatus for energizing the scanning electrodes of a matrix-addressed AC TFEL panel in a way that conserves energy and allows for the use of larger panels.

Conventional AC matrix-addressed TFEL panels include a set of scanning electrodes and a set of data electrodes sandwiching an electroluminesscent (EL) phosphor laminate. In general, selected data electrodes are energized as the scanning electrodes are energized a line at a time. Once all of the scanning electrodes have been energized in this fashion, a frame of data has been completed. Usually the scanning electrodes are arranged as row electrodes extending from right to left and all are connected to a power source which comprises a high current power IC to provide the scanning voltage. The scanning voltage is selectively gated onto each individual row electrode by individual row driver transistors which act as switches under the control of logic circuits. An example of the way in which the electrodes of this type are conventionally arranged is shown in the U.S. Patent to Kinoshita, et al., U.S. Pat. No. 4,485,379.

An improvement to such conventional TFEL panels is shown in Dolinar, et al., U.S. Pat. No. 4,739,320 which is assigned to the assignee of the present application. The Dolinar, et al. patent discloses a split screen architecture for matrix-addressed AC TFEL panels in which the column drivers are split into top and bottom segments which are separately driven. This enables the row drivers to drive top and bottom row electrodes simultaneously. This conserves energy in the panel and provides for a higher frame repetition rate because of the time savings realized by scanning the top and bottom portions of the screen simultaneously. A drawback to the design of Dolinar, et al. is that the row drivers are driven with the same polarity both in the top and bottom sectors of the screen simultaneously. This places demands on the power supply powering the row driver IC's, and the result is that the power supplies must be made physically large to accommodate the peak energy requirements. This in turn has negative consequences for the overall size of the panel because long electrodes are required for larger panel sizes resulting in a corresponding need for an increase in the size of the power supply. TFEL panels provide an advantage over conventional cathode ray tube displays because of their compact size. If a very large power supply is required, however, this advantage becomes diminished.

A variation of the Dolinar, et al. driving scheme is shown in Flegal, U.S. Pat. No. 4,733,228 assigned to the same assignee and which is incorporated herein by reference. The Flegal patent discloses a symmetric drive scheme where the scanning electrodes are alternately driven positive and negative on alternating frames. A still further variation of this concept is shown in U.S. patent application Ser. No. 166,417 also assigned to the same assignee and now abandoned. According to this application, the row or scanning electrodes alternate between driving voltages of positive and negative polarity as the rows are scanned from top to bottom and polarities are reversed every frame. The problem with this approach is that if the electrodes are arranged in the manner suggested by the Dolinar, et al. '320 patent, the positive and negative power supplies would still be called upon to deliver twice the power for every row electrode that is scanned because the electrodes are connected to the power supply in complementary top and bottom pairs.

A desirable object in the design of such panels would be to utilize split screen architecture along with line by line symmetric drive while at the same time decreasing the overall power requirements for the scanning electrodes, thus permitting a more compact electronics package. This would also enable larger panels to be fabricated without an attendant increase in the size of the power supplies.

SUMMARY OF THE INVENTION

The present invention provides a method and apparatus for energizing the scanning electrodes of an AC TFEL matrix-addressed panel in a way that conserves energy and permits conventionally sized electronics components to drive a larger TFEL display. The scanning electrodes are divided into two primary groups, those driven from the left side of the panel and those driven from the right side of the panel. The electrodes in these groups are interleaved in alternating fashion across the panel from top to bottom. In addition, the left and right side scanning electrodes, which may be viewed as odd and even row electrodes, respectively, are divided into two subsets, one of which is located in the top half of the panel and the other of which is located in the bottom half. The panel employs split screen architecture, and as such, the data or column electrodes are divided into colinearly aligned complimentary pairs extending towards each other from opposite sides of the panel for a distance slightly less than halfway across the screen.

The top and bottom halves of the screen are driven simultaneously, and in accordance with the invention, the rows are scanned in line-by-line fashion where a row in the top half of the panel is scanned with a first polarity voltage when, simultaneously, a row in the bottom half of the panel is scanned with an opposite polarity voltage. For example, all odd rows may be scanned with a negative voltage on a first frame, while all even rows are scanned with a positive voltage on the same frame. On the next frame the polarity may be reversed so that the odd rows are scanned with a positive voltage and the even rows are scanned with a negative voltage. Moreover, an odd row located in, for example, the top half of the panel may be scanned simultaneously with the scanning of an even numbered row located in the bottom half of the panel. This provides for the simultaneous scanning of bottom and top halves of the panel while using less energy than would be required for the same type of scanning using the drive scheme of U.S. Pat. No. 4,739,320 mentioned above. This is because a positive power supply drives one electrode while a negative power supply drives the other. This reduces the power required because the demand is divided between positive and negative supplies, while the top and bottom scanning electrodes are energized simultaneously. This provides the advantages of split screen architecture and alternate line symmetric drive scanning while reducing the peak energy requirements for the scanning electrode power supplies.

It is a principal object of this invention to provide a method and apparatus for scanning an AC matrix-addressed TFEL panel having split screen architecture and utilizing symmetric drive techniques to conserve energy, simplify the electronics layout for the panel, and provide higher current for the scanning electrodes thus enabling larger panels to be constructed.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
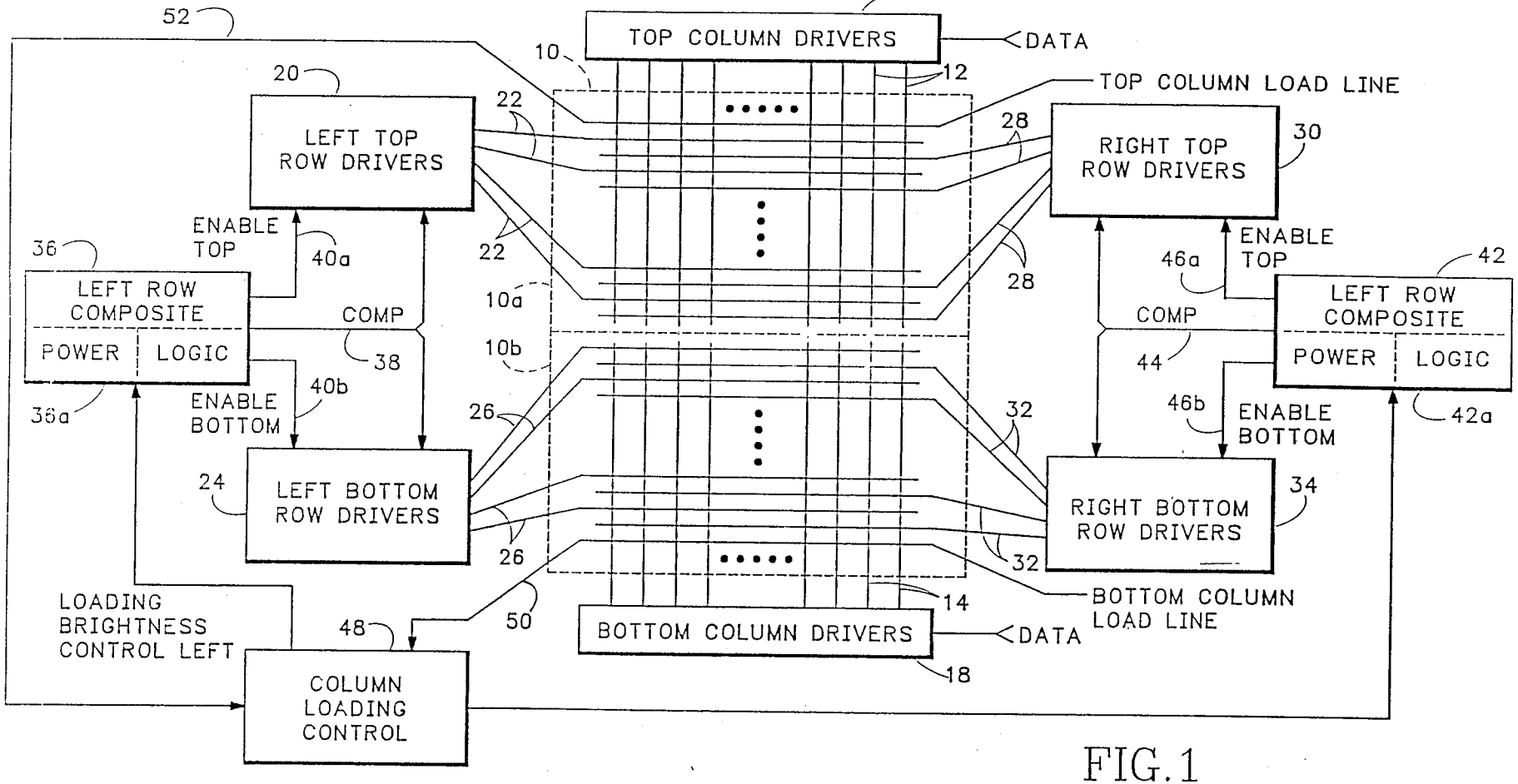
FIG. 1 is a block schematic diagram of an AC matrix addressed TFEL panel employing the scanning electrode network of the present invention.

An AC matrix addressed TFEL display device includes a panel 10. The panel 10 includes a glass substrate (not shown separately) supporting a thin film electroluminescent layer sandwiched between insulator layers (not separately shown). This type of structure is well-known in the art as shown, for example, in Barrow et al., U.S. Pat. No. 4,719,385 "MULTI-COLORED THIN-FILM ELECTROLUMINESCENT DISPLAY," Jan. 12, 1988.

A set of top column electrodes 12 which function as data electrodes are aligned across the panel from top to bottom and extend from the top towards the middle of the panel for a distance slightly less than halfway across. Bottom column electrodes 14 extend from the bottom of the panel 10 towards the middle in lines which are colinear with respective ones of the top column electrodes 12. This construction is generally in accordance with the split-screen architecture of the Dolinar et al. '320 patent cited above. The column electrodes 12 and 14 are driven, respectively, by top column drivers 16 and bottom column drivers 18.

A set of left top row drivers 20 drives the odd-numbered scanning electrodes 22 in the top half 10*a* of the panel 10. A left bottom row driver 24 drives the odd-numbered scanning electrodes 26 in the bottom half 10*b* of the panel 10. Top even-numbered scanning electrodes 28 are driven by a set of right top row drivers 30 and the bottom even-numbered scanning electrodes 32 are driven by a set of right bottom row drivers 34. A left row composite network 36 provides a power signal on line 38 to both the left top row drivers 20 and the left bottom row drivers 24. The left row composite network also includes a logic section 36*a* which provides enable signals on lines 40*a* and 40*b* to the left top row drivers 20 and the left bottom row drivers 24, respectively. Similarly, on the right side of the panel 10, a right row composite network 42 provides a power signal to the right top row drivers 30 and to the right bottom row drivers 34 on line 44. A logic section 42*a* of the right row composite 42 includes enable lines 46*a* and 46*b* which control the gating of the power signal onto the electrodes 28 and 32 through the right top row drivers 30 and the right bottom row drivers 34.

A column loading control 48 receives inputs from a bottom column load line 50 and a top column load line 52. Depending upon the number of columns that are energized during the scanning of each row, the column loading control 48 provides a signal to both the right row composite 42 and the left row composite 36. Because energized column electrodes provide more capacitance and, hence, present a higher capacitive load to the left and right row composites 36 and 42, the signal from the column loading control 48 alters the pulse width of the power signal provided by the left and right row composites accordingly.

Figure 2:
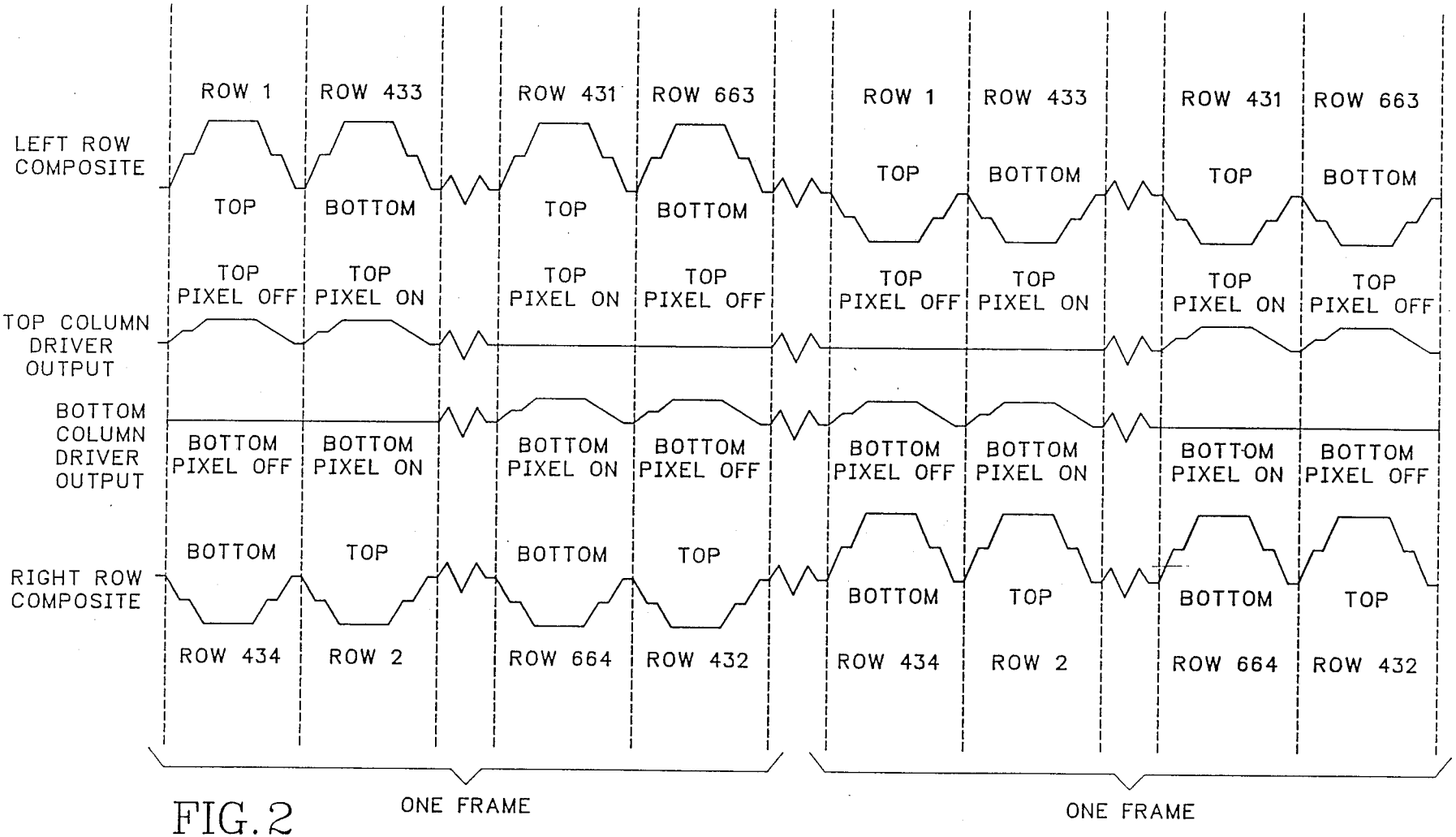
FIG. 2 is a waveform diagram illustrating the method of operation of the scanning electrode network shown in FIG. 1.

FIG. 2 illustrates the method of operation of the scanning sequence. The row electrodes in the top and bottom halves of the panel 10 are energized in line-by-line sequence. For example, the device of FIG. 1 may contain 864 row electrodes. Thus, when row 1, which lies in the top half of the screen, is scanned with a positive voltage, an even-numbered row, row 434 which lies in the bottom half of the screen, is scanned with a negative voltage. On the next scan, row 2, which lies in the top half of the panel, is scanned with a negative voltage. Simultaneously, row 433 which lies in the bottom half of the panel, is scanned with a positive voltage. This sequence continues until a frame has been completed. At this point the polarity is reversed and the odd-numbered rows, which are driven from the left hand side of the screen, are scanned negatively while the even-numbered rows are scanned with a positive voltage. Two rows are always scanned simultaneously, one being odd and the other being even, and situated in opposite halves of the panel, but are scanned with voltages of differing polarities to decrease the peak power requirements for the power supply driving the composite networks 36 and 42, respectively. This enables components of the power supplies to be made smaller relative to the size of the panel. The end result is that the panels may be made larger since the power supplies are capable of providing a higher current.

Since the polarity of the rows being scanned in the top and bottom halves of the panel, reverses for each separate scan, the data logic for the column electrodes is different for the top column drivers 16 and the bottom column drivers 18, respectively. For example, in a first frame, in order to illuminate a pixel in row 2, the top column driver output would be high. The bottom driver column output would be low, however, to illuminate a pixel in row 433 at the same time that a pixel in row 2 were being illuminated.

Once the entire panel 10 has been scanned, that is, when all 864 rows have been "written" with a positive or negative power signal, the polarity reverses. This requires a corresponding reversal in the column driver logic. On the next frame, to illuminate pixels in Row 433, the bottom column drivers are high; to illuminate a pixel in row 2, the top columns are low.

In general, the layout of the electrodes has been described in terms of the conventional manner of assigning functions to the electrodes. Thus, the scanning electrodes are generally laid out as horizontal rows and the data electrodes are vertical columns. However, the invention is not limited to any such layout and applies equally to scanning and data function electrodes which may be laid out vertically and horizontally, respectively, or even patterned in some unorthodox manner. Thus, the terms "row," "column," "top" and "bottom" are relative and the invention does not depend upon the particular orientation of the panel, but only upon the functions of the components therein.

Appropriate voltage levels for generating the wave forms in FIG. 2 are +210 volts for the positive row scanning voltages, −160 volts for the negative row scanning voltages, and +50 volts or zero for the column voltages, Thus, a combination of +210 on a row electrode and zero on certain columns will place a charge across those portions of the panel needed to illuminate selected pixels. However, at the same time a column charge of +50 volts will keep those particular pixels dark. This is due to the fact that for the panel 10, 210 volts is just above the threshold of luminescence, but +160 (210v−50v) is not. Correspondingly when a negative (−160 volt) scan is used, those columns having a charge of +50 volts cause luminescence because the potential across the panel is −210 volts (−160v−50v), while those columns with zero voltage are below the threshold of luminescence at −160 volts.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A scanning network for a matrix-addressed AC TFEL panel comprising first and second pluralities of scanning electrodes alternately interleaved with respect to each other across said panel, said first plurality connected to a first power source and said second plurality connected to a second power source, first and second pluralities of data electrodes, said first plurality of data electrodes occupying a first half portion of said panel and said second plurality of data electrodes occupying a second half portion of said panel, each plurality of said electrodes comprising an array of parallel electrode members disposed at right angles to said first and second pluralities of scanning electrodes and extending slightly less than halfway across said panel in the respective half portions thereof, and logic means for energizing a scanning electrode in said first plurality located in said first half portion of said panel with a positive power signal while simultaneously energizing a different scanning electrode in said second plurality located in said second half portion of said panel with a negative power signal.

2. The scanning network of claim 1 wherein said first and second pluralities of electrodes each comprise first and second electrode subsets wherein electrodes in each of said first and second subsets are scanned in line by line fashion simultaneously.

3. A method of energizing the scanning electrodes of a matrix-addressed AC TFEL panel wherein said panel comprises data electrodes having a first set of elongate parallel conductive strips extending slightly less than halfway across said panel from a first edge thereof to occupy a first half portion of said panel, and a second set of elongate parallel conductive strips extending slightly less than halfway across said panel from a second and opposite edge thereof to occupy a second half portion of said panel, and wherein said panel includes first and second sets of scanning electrodes disposed at right angles to said data electrodes and alternately interleaved across said panel, comprising the steps of:

(a) during a first frame of data: energizing said scanning electrodes in said first and second sets in line by line fashion wherein a first electrode in said first set and situated in said first half portion of said panel is energized with a signal of a first polarity simultaneously with energizing a second electrode in said second set situated in said second half portion of said panel with a signal of an opposite polarity; and (b) during a next frame of data: Energizing the electrodes in said first and second sets of scanning electrodes in line by line fashion wherein said first electrode in said first set is energized with a signal of said opposite polarity simultaneously with energizing said second electrode in said second set with a signal of said first polarity.

4. The method of claim 3 wherein said signal of said first polarity is a positive voltage and said signal of said second polarity is a negative voltage.

5. The method of claim 4 wherein said first and second sets of electrodes each comprise top and bottom electrode subsets, wherein one electrode from a top subset is energized simultaneously with one electrode from a bottom subset.

* * * * *